US005681151A

United States Patent [19]

Wood

[11] Patent Number: 5,681,151

[45] Date of Patent: Oct. 28, 1997

[54] MOTOR DRIVEN AIR COMPRESSOR HAVING A COMBINED VENT VALVE AND CHECK VALVE ASSEMBLY

[75] Inventor: Mark W. Wood, Jackson, Tenn.

[73] Assignee: DeVilbiss Air Power Company, Jackson, Tenn.

[21] Appl. No.: 617,319

[22] Filed: Mar. 18, 1996

[51] Int. Cl.[6] ..... F04B 49/035

[52] U.S. Cl. ..... 417/307; 417/36; 137/115.06; 137/115.16

[58] Field of Search ..... 417/36, 440, 307, 417/44.2; 137/115.06, 115.16, 115.28, 539; 251/331

[56] References Cited

U.S. PATENT DOCUMENTS

| | | | |
|---|---|---|---|
| 1,857,666 | 5/1932 | Smallhouse | 137/115.16 |
| 2,069,153 | 10/1937 | Konkle | 137/539 |
| 3,559,016 | 1/1971 | Gerteis | 318/221 |
| 3,725,757 | 4/1973 | Ehrens et al. | 318/221 C |
| 4,342,573 | 8/1982 | McCombs et al. | 55/161 |
| 4,465,962 | 8/1984 | Kirschbaum | 318/817 |
| 4,672,284 | 6/1987 | Ward | 318/752 |
| 5,166,568 | 11/1992 | Nystuen et al. | 310/254 |
| 5,498,138 | 3/1996 | Nimberger et al. | 417/440 |

*Primary Examiner*—Timothy Thorpe
*Assistant Examiner*—Cheryl J. Tyler
*Attorney, Agent, or Firm*—MacMillan, Sobanski & Todd

[57] ABSTRACT

An air compressor driven by a permanent split capacitor electric motor of the type having substantially the same value capacitance for starting as for operating and which has insufficient starting torque for starting when the air compressor is loaded with pressurized air. The pressurized air output from the air compressor is delivered through an air line to a compressed air storage tank. A check valve between the air line and the tank permits air flow from the air line to the tank while preventing a reverse air flow. A vent valve is connected to vent air pressure from the air line when the motor is stopped to unload the air compressor. When the motor is restarted, closure of the vent valve is delayed until the output torque from the motor exceeds the torque requirements of the compressor when loaded. Vent valve closure may be delayed for a predetermined me or until the motor reaches a predetermined high operating speed or until the air flow from the unloaded air compressor reaches a predetermined level.

8 Claims, 4 Drawing Sheets

MOTOR DRIVEN AIR COMPRESSOR HAVING A COMBINED VENT VALVE AND CHECK VALVE ASSEMBLY

TECHNICAL FIELD

The invention relates to air compressors and more particularly to an air compressor driven by a permanent split capacitor electric motor and to an unloader valve therefor.

BACKGROUND ART

Air compressors are commonly driven by either electric motors or gasoline engines. A typical electric motor powered air compressor of the type commonly used for operating spray guns and pneumatic tools, and the like, consists of a motor driven compressor connected through an air line to an air tank, a one way check valve located between the air line and the air tank to prevent air flow from the air tank back to the compressor, a pressure relief valve connected to unload the air line when the motor is stopped, and a pressure responsive switch which operates the motor and the pressure relief valve in response to the air tank pressure. The pressure responsive switch has a preset high turn off pressure and a preset low turn on pressure. The turn on and turn off pressures are generally adjustable by the compressor operator. When the motor is driving the air compressor and the pressure in the air tank reaches the set upper limit, the pressure responsive switch shuts off the motor and also opens the pressure relief valve to vent air pressure from the air line connected between the compressor and the air tank. By venting the air pressure from the air line, the compressor is unloaded and the motor torque required to start the compressor is significantly reduced. When the pressure in the air tank falls to the set turn on pressure, the motor is started and the pressure relief valve is closed. Because of the very small volumetric capacity of the air line and the compressor head, the air pressure in the line quickly increases and hence the torque required to drive the compressor quickly increases when the motor is first started.

In order to prevent the motor from stalling, it is necessary for the motor to be able to continuously deliver an output torque greater than the torque required to drive the air compressor. This is of particular concern during motor startup. During a restart when the air tank is at the preset turn on pressure, the pressure very quickly increases in the compressor head and the air line as air is pumped into the head and the connected air line up to the check valve as the motor accelerates to operating speed. As the pressure quickly increases, the compressor torque requirements simultaneously increase. If the motor output torque fails to remain ahead of the compressor torque requirements, the motor will stall and fail to restart. For this reason, compressor motors have had to be designed with some form of auxiliary start assist, such as a start capacitor and switch or an induction start switch. High starting torque motors are more complex and generally cost more than non-assisted starting motors, such as a single capacitor permanent split capacitor (PSC) motor. When permanent split capacitor motors have been used to drive compressors, they have needed a separate starting capacitor in order to establish the needed starting torque. Not only does the starting capacitor add to the cost of the motor, but it also generally needs to be switched out of the motor circuit after the motor has reached operating speeds in order to prevent excessive heating and to maintain operating efficiency. In order to reduce the costs for manufacturing air compressors, it would be desirable to design a compressor which permits use of a low cost electric motor of the type having low starting torque.

DISCLOSURE OF INVENTION

The invention is directed to an air compressor designed for operation with low starting torque motors, such as permanent split capacitor motors of the type having a single capacitor for starting and operating. The PSC motor is a capacitor motor with the same value of effective capacitance in series with its auxiliary winding for both starting and running operations. It has the advantages of lower manufacturing cost and simpler design and operating efficiency. However, the starting portion of its speed vs torque curve has been too low in torque to permit use in state of the art air compressor systems. In order to keep the compressor torque demands low enough during starting to permit use of a PSC motor without a separate starting capacitor, the pressure relief valve which unloads the compressor when the motor is stopped is held open a sufficiently long time during the start cycle for the motor speed and torque to exceed the starting torque requirements of the loaded air compressor. The pressure relief valve is kept open either for a fixed time during starting or until the motor reaches a desired speed or until the air flow from the compressor reaches a predetermined flow rate. This allows the motor to reach its operating speed despite its low starting torque.

The check valve between the compressor air line and the air tank and the unloader valve may be combined into a single valve assembly. When the compressor is stopped, the unloader valve is held open by a spring. When the motor is first started, the initial low air flow from the compressor is vented through the unloader valve. There will be a pressure drop across the unloader valve which is a function of the air flow rate through the valve. When the air flow rate through the unloader valve reaches a level which corresponds with the motor output torque exceeding the torque requirements of compressor, the unloader valve is closed by the air flow through the unloader valve. The pressure in the air line will immediately begin to increase and will hold the unloader valve closed. When the pressure responsive switch opens to stop the motor, it also opens a valve in the switch which bleeds pressure from the unloader valve, thus permitting the valve spring to open the unloader valve. Alternately, the pressure responsive switch may bleed pressure from the compressor air line and the compressor head when the motor is switched off. A flow responsive valve may be mounted in the compressor head for opening when the air pressure is bled off and for delaying compressor loading until the motor torque has sufficiently increased during starting.

Accordingly, it is an object of the invention to provide a low cost air compressor which operates with a permanent split capacitor motor without a separate starting capacitor.

Other objects and advantages of the invention will become apparent from the following detailed description of the invention and the accompanying drawings.

BEST MODE FOR CARRYING OUT THE INVENTION

Figure 1:
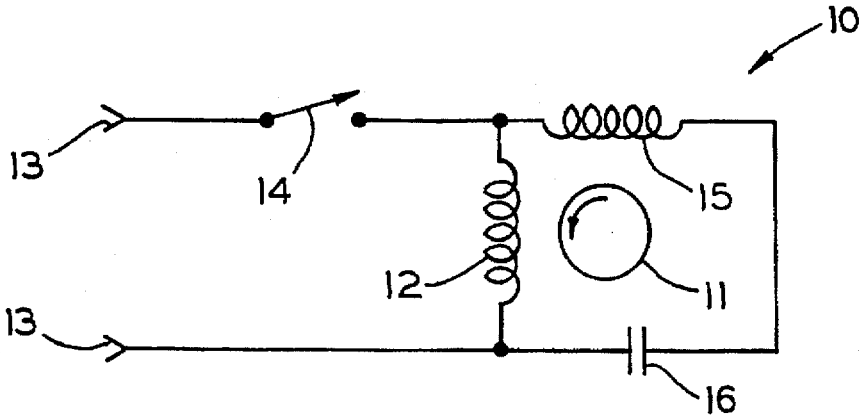
FIG. 1 is a schematic circuit diagram for a permanent split capacitor motor for operating an air compressor according to the invention.

Referring now to the drawings, FIG. 1 shows a schematic diagram for a permanent split capacitor motor 10 for use in an air compressor according to the invention. The motor, which is of a simple single phase design, has a rotor shaft 11. There are two windings for driving the motor from a standard alternating current power source. A main winding 12 is connected to power terminals 13. If desired, an on/off switch 14 may be connected in series between the winding 12 and one of the terminals 13. An auxiliary winding 15 and a capacitor 16 are connected electrically in series with each other and in parallel with the main winding 12. The capacitor provides for a phase shift in the alternating current to and limits the current in the auxiliary winding 15.

For maximum starting torque, it is desirable that the capacitor 16 have a significantly larger value for starting than for running in order to provide a higher starting current in the auxiliary winding 15 to increase the starting torque. However, this adds significantly to the cost of the motor 10 and also some type of switch is required to connect two capacitors in parallel during starting and to automatically disconnect the starting capacitor during running. If the capacitor 16 has a large value during running, an excessive current will flow through the auxiliary winding 15, thus reducing the operating efficiency and producing excessive heat. On the other hand, if the capacitor 16 always has the optimal low value needed for running, the starting current in the winding 15 is limited and consequently, the motor 10 will have a low starting torque. According to the invention, the capacitor 16 used in the motor 10 is fixed at the desired running value in order to simplify the design and to reduce the cost of the motor 10. Therefor, the motor 10 has a low starting torque. The motor 10 will start by reducing the torque required by the compressor during the start cycle to below that produced by the motor 10.

Figure 2:
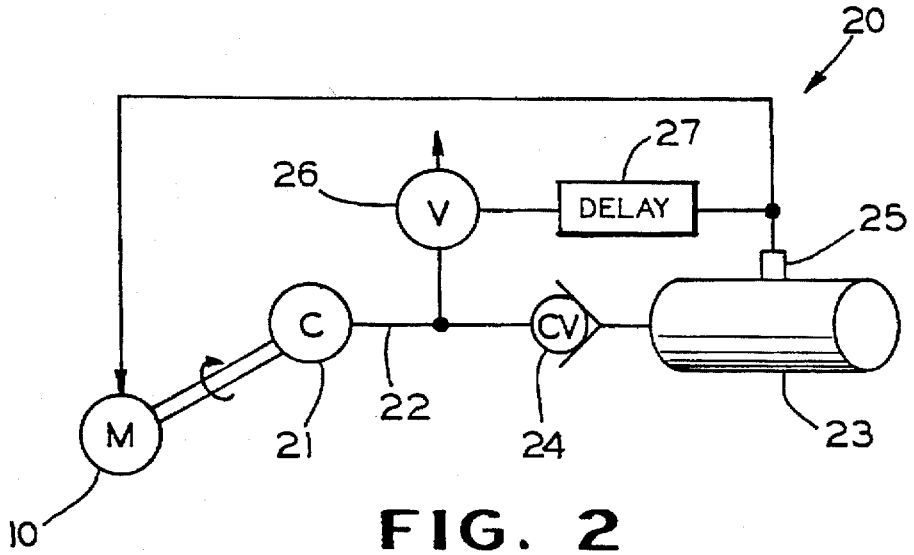
FIG. 2 is a schematic diagram of an air compressor according to a first embodiment of the invention.

FIG. 2 is a schematic diagram of an air compressor 20 according to a first embodiment of the invention. The motor 10 is connected to drive a conventional compressor 21, which is preferably a reciprocating piston type compressor. The pressurized air output from the compressor 21 is delivered through an air line 22 to an air tank 23. A check valve 24 is located between the air line 22 and the tank 23 to prevent any compressed air flow from the tank 23 to the air line 22. A conventional pressure switch 25 is mounted on the air tank 23 and is responsive to the air pressure in the tank to open and close switch contacts (not shown). The pressure switch 25 is adjusted to open the contacts to shut off the motor 10 when the air pressure in the tank 23 reaches a set high pressure level and to close the contacts to start the motor 10 when the air pressure in the tank 23 drops below a set low pressure level. In a conventional air compressor, the switch 25 also may include a valve which bleeds air pressure from the air line 22 when the motor 10 is shut off. This unloads the compressor 21 to minimize the load on the motor 10 during initial motor startup. However, in this prior art arrangement, it was necessary to design the motor to provide sufficient startup torque to stay ahead of the rapidly increasing compressor torque demands.

According to a first embodiment of the invention, a valve 26 is connected for venting air pressure from the air line 22. The vent valve 26 may be a normally, open solenoid operated valve. Whenever the motor 10 is turned off, the valve 26 will remain open to vent pressure from the air line 22 and a compressor head (not shown). The pressure switch 25 is connected through a time delay circuit 27 to close the valve 26. When the pressure within the air tank 23 drops sufficiently that the switch 25 closes to turn on the motor 10, power is applied to the delay circuit 27. The circuit 27 closes the valve 26 a predetermined time after the pressure switch 25 closes. This predetermined time delay is set sufficiently long to allow the motor 10 to start up with only the low torque requirements of the unloaded compressor 21. After the speed of the motor 10 is sufficiently high that its output torque will continue to exceed the demands of the compressor 21, the delay circuit 27 closes the valve 26 and the compressor 21 will then deliver pressurized air to the air tank 23.

Figure 3:
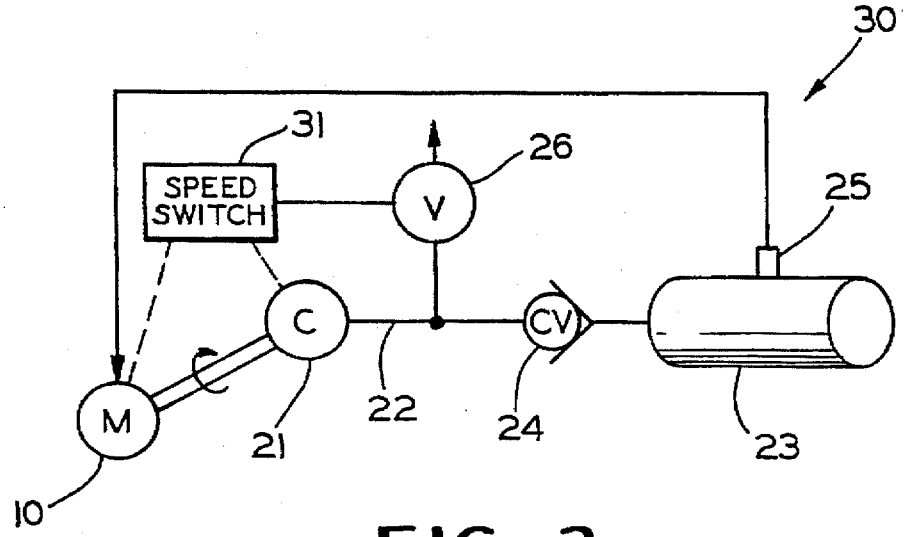
FIG. 3 is a schematic diagram of an air compressor according to a second embodiment of the invention.

FIG. 3 illustrates a second embodiment of an air compressor 30. The air compressor 30 also includes the motor 10 connected to drive the compressor 21. The pressurized air output from the compressor 21 is delivered through the air line 22 and the check valve 24 to the air tank 23. The pressure responsive switch 25 is connected to turn on the motor 10 when the air pressure in the tank 23 drops below a set lower limit and to shut off the motor 10 when the air pressure in the tank 23 reaches a set upper limit. The air line 22 is connected to the vent valve 26. A speed responsive switch 31 responds to the speed of the motor 10 or of the connected compressor 21. Contacts (not shown) within the switch 31 are open when the motor 10 is stopped and are closed when the motor 10 reaches a predetermined high speed during start up. The switch 31 controls the vent valve 26. The vent valve 26 is normally open to vent the air line 22 and the head of the compressor 21 when the motor 10 is stopped and initially starting up. The switch 31 may be a centrifugal switch or it may be an electronic switch. When the motor 10 reaches a predetermined operating speed, the speed switch 31 closes the vent valve 26 and pressurized air is delivered from the compressor 21 to the air tank 23.

Figure 4A:
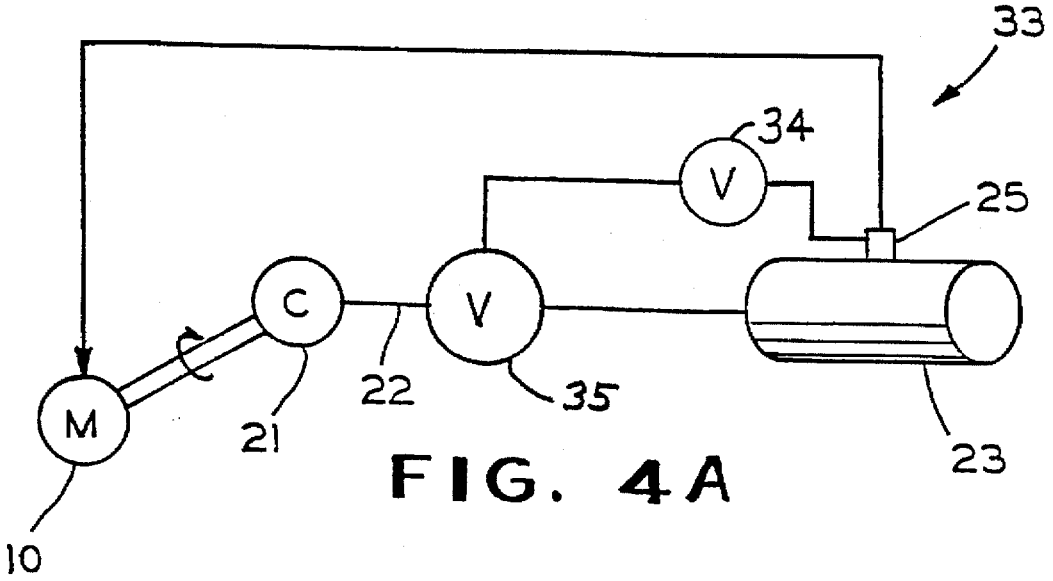
FIG. 4 is a schematic diagram of an air compressor according to a third and preferred embodiment of the invention.
Figure 4:
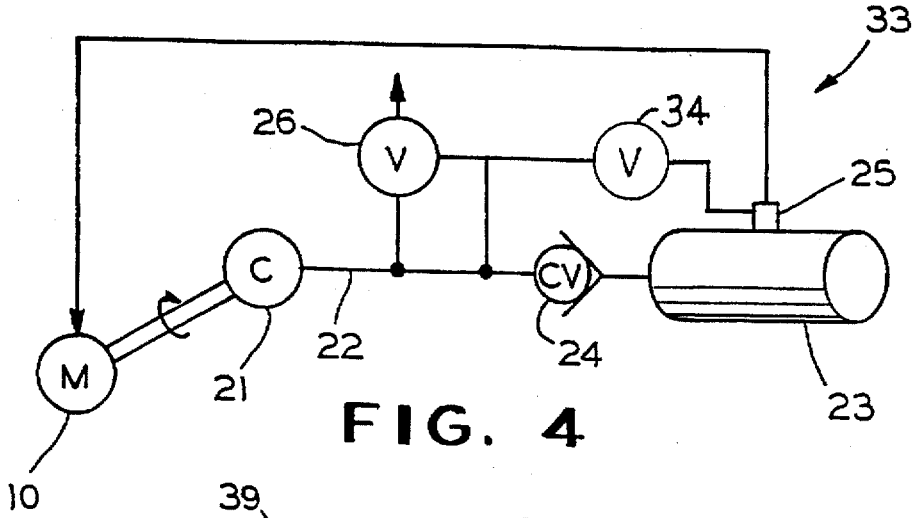

FIG. 4 illustrates a third and preferred embodiment of an air compressor 33 according to the invention. Again, the motor 10 is connected to drive the compressor 21. The pressurized air output from the compressor 21 is applied through the air line 22 and the check valve 24 to the air tank 23. Some commercial pressure switches 25 include a valve 34 which is opened when the switch is open and closed when the switch is closed. These switches are used to bleed off pressure in the air line 22 which connects between the compressor 21 and the air tank check valve 24. The pressure switch 25 turns on the motor 10 at a set low pressure in the air tank 23 and turns off the motor 10 at a set high pressure in the air tank 23. The valve 34 vents pressure from the air line 22 and the head of the compressor 21 when the motor 10 is stopped. When the motor 10 is started, the air flow delivered from the compressor 21 to the air line 22 flows through the vent valve 26 to atmosphere. It will be appreciated that the total air flow through the vent valve 26 will be a function of the speed of the motor 10. The vent valve 26 is designed to close in response to a predetermined high air flow. Consequently, there will be a minimal load on the motor 10 until it reaches the speed necessary for the vented air flow to close the vent valve 26. The vent valve 26 will then be held closed by the air pressure in the air line 22. When the pressure switch 25 stops the motor 10, the valve 34 bleeds off pressure in the air line 22 and also the pressure which keeps the vent valve 26 closed. When the pressure is bled off, the valve 26 will open and will remain open until the motor 10 again drives the compressor 21 at a sufficient speed to create the air flow necessary to close the vent valve 26.

Figure 5:
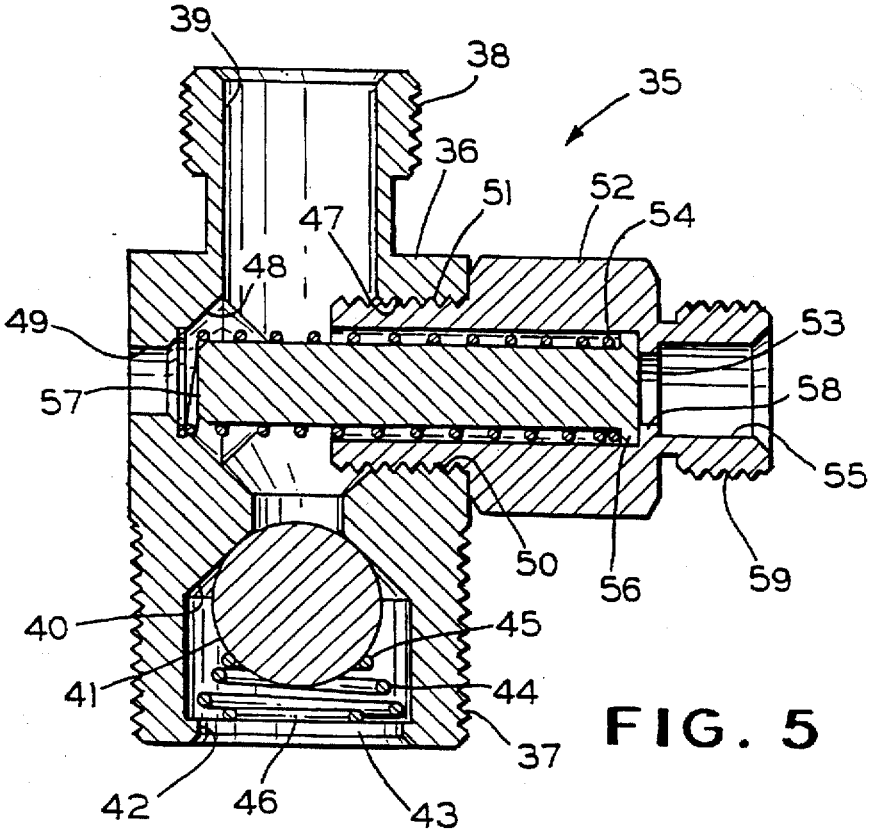
FIG. 5 is an enlarged cross sectional view through a combined check valve and unloader valve for the air compressor of FIG. 4.

The vent valve 26 and the check valve 24 may be combined into a single valve assembly 35, as shown in FIGS. 4A and 5. The valve assembly 35 includes a main valve body 36 having an externally threaded end 37 for engaging a corresponding threaded opening (not shown) in the air tank 23. A second threaded end 38 is located opposite the end 37. The air line 22 is connected to the threaded end 38 with a conventional pipe fitting (not shown). A stepped bore 39 extends through the body 36 between the threaded ends 37 and 38. A conical step 40 in the bore 39 forms a seat for a check valve ball 41. An annular ledge 42 extends radially inwardly at an end 43 of the bore 39 in the body end 37. A compression spring 44 is compressed between the ledge 42 and the check valve ball 41 to urge the check valve ball 41 against the seat 40, thus preventing air flow from the air tank 23. When the air pressure in the air line 22 is above the air pressure in the air tank 23, the valve ball 41 is unseated and pressurized air will flow through the bore 39 into the air tank 23. When the air pressure in the air line 22 drops below the air tank pressure, the spring 44 will again seat the valve ball 41 to prevent the loss of air pressure from the air tank 23 through the valve assembly 35. The valve assembly 35 provides several advantages. It combines the unloader valve and spring into the pressure relief port connector body. Further, when in the open position, the unloader valve stem is not inside of the vent hole. This provides a greater flow area through the vent passage and improves starting performance.

Figure 6:
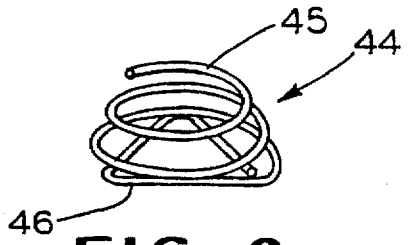
FIG. 6 is an enlarged perspective view of a check valve spring for the combined valve of FIG. 5.

FIG. 6 illustrates details of a preferred embodiment of the compression spring 44. The compression spring 44 is a generally conical wire wound spring which tapers towards a small diameter end 45 which engages the check valve ball 41. At an opposite end 46, the spring wire is formed into a triangle. The triangular end 46 is sized to engage and be retained on the ledge 42 in the bore 39 through the main valve body 36.

Referring again to FIG. 4A and 5, a second bore 47 is formed through the main valve body 36. The second bore 47 communicates with the bore 39. The second bore 47 includes a conical seat 48 adjacent an open end 49 which vents to atmosphere on one side of the body 36. On an opposite side of the body 36, the second bore 47 has a threaded end 50 which receives a corresponding threaded end 51 of an unloader valve body 52. An unloader valve 53 and a compression spring 54 are confined within a bore 55 through the unloader valve body 52. The spring 54 is compressed between the conical seat 48 and a radial shoulder 56 on the unloader valve 53 to urge an end 57 of the unloader valve 53 away from the seat 48. The spring 54 urges the valve shoulder 56 against a ledge 58 in the bore 55. The unloader valve body 52 has an externally threaded end 59 opposite the threaded end 51. The bore 55 extends between the ends 51 and 59. The threaded end 59 is adapted to connect to the air line which connects to the valve 34 on the pressure switch 25.

In operation of the valve assembly 35, it will be assumed that the threaded end 37 is secured to the air tank 23 which contains some air pressure and that the motor 10 is initially stopped. The check valve ball 41 will engage the seat 40 due to both the action of the spring 44 and the tank air pressure to prevent loss of tank air pressure through the valve assembly 35. The spring 54 will hold the unloader valve 53 away from the seat 48 to provide an open vent for the air line 22 and the compressor head. When the compressor motor 10 is initially started, the unloader valve 53 will initially remain away from the seat 48. As the motor speed increases, the flow of air through the open bore end 49 increases. When the air flow exceeds a level wherein the torque from the motor 10 will exceed the maximum torque demands of the compressor 21, the vented air flow pulls the unloader valve 53 towards the seat 48 to interrupt venting of the air line 22. The air pressure in the air line 22 immediately increases. This increased air pressure is applied through the bore 55 to the unloader valve 53 to hold the unloader valve 53 against the seat 48. When the air pressure in the air line 22 exceeds the tank air pressure, the check valve ball 41 will separate from the seat 40 and pressurized air will flow from the compressor 21 to the air tank 23. When the motor 10 is stopped, the check valve ball 41 will again engage the seat 40, the pressure switch 25 will vent the air line 22 and the spring 54 will again move the unloader valve 53 away from the seat 48.

Figure 7:
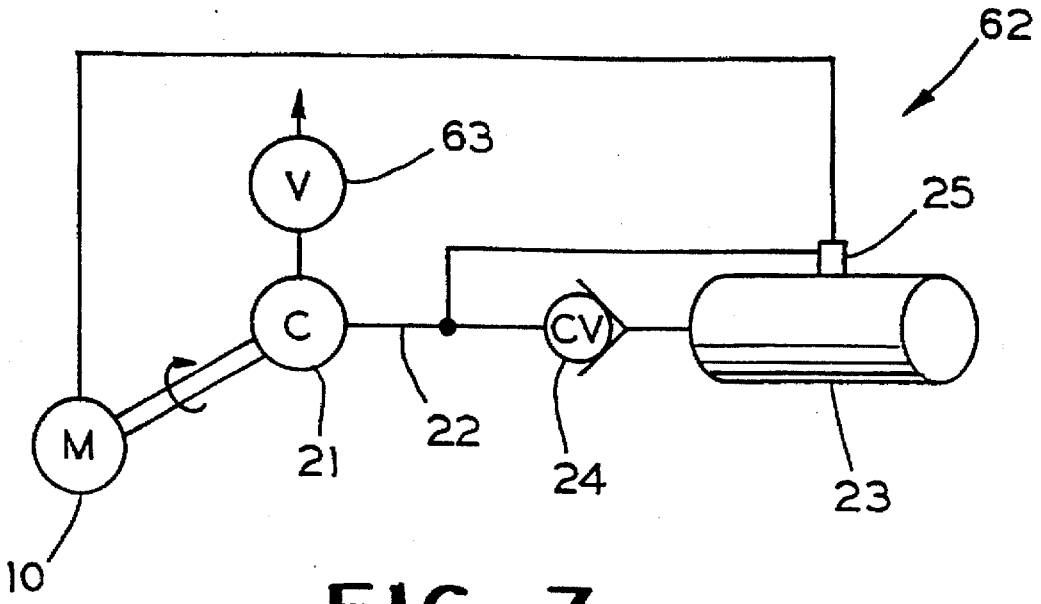
FIG. 7 is a schematic diagram of an air compressor according to a fourth embodiment of the invention.

FIG. 7 shows an air compressor 62 according to a fourth embodiment of the invention. The permanent split capacitor motor 10 again drives the compressor 21 for delivering pressurized air through the line 22 and the check valve 24 to the air tank 23. The pressure responsive switch 25 senses the air pressure within the tank 23 for turning on the motor 10 when the tank pressure drops to a preset low level and for turning off the motor 10 when the tank pressure increases to a preset high level. When the pressure responsive switch 25 is open, an integral valve 34 in the switch 25 bleeds pressure from the air line 22 and from the head of the air compressor 21 to unload the compressor 21. A vent valve 63 in the form of a mechanical flow responsive valve is mounted directly in the head of the compressor 21. When the air compressor 21 is unloaded by the pressure switch 25, the vent valve 63 will open. The vent valve 63 will remain open until the compressor air flow through the vent valve 63 reaches a predetermined high level. The vent valve 63 is designed to remain open until the available torque from the starting motor 10 exceeds the torque demands of the air compressor 21 when loaded. The vent valve 63 will then close and remain closed until the air pressure is removed from the air line 22 and the cylinder head. Although the valve 63 is closed in response to air flow, it should be appreciated that the air flow will be a function of the motor speed.

Figure 8:
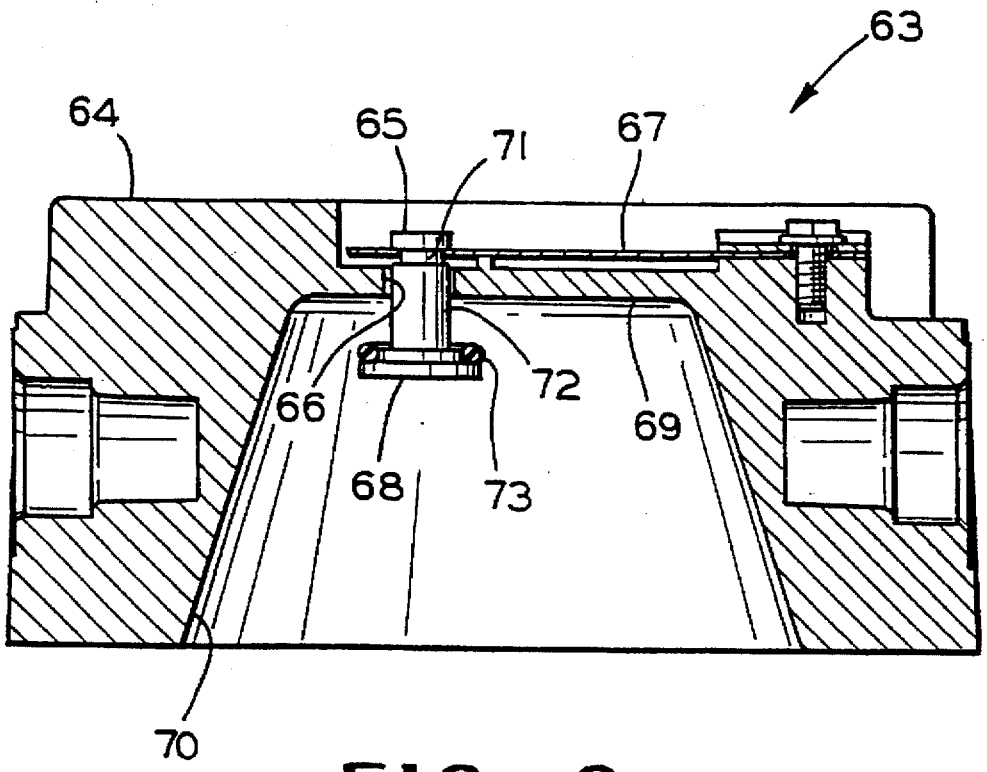
FIG. 8 is an enlarged cross sectional view through a compressor head showing an unloader valve for the air compressor of FIG. 7.

FIG. 8 shows details of the vent valve 63 mounted in a compressor cylinder head 64. A valve member 65 is retained in an opening 66 through the cylinder head 64 by a leaf spring 67. The leaf spring 67 urges the valve member 65 to a normally open position wherein a head 68 on the valve member 65 is spaced from an interior cylinder head surface 69 in a compression chamber 70. The leaf spring 67 engages a groove 71 on a shaft 72 of the valve member 65 which extends from the head 68 through the cylinder head opening 66. A clearance is provided between the shaft 72 and the cylinder head opening 66 to permit the venting of air from the compression chamber 70 when the valve member 65 is in the illustrated open position. Preferably, the shaft 72 has a cross section other than round, such as in the form of a cross to provide increased area for air flow.

In the orientation shown in FIG. 8, the leaf spring 67 urges the valve member 65 in a downward direction to the illustrated position with the head 68 spaced from the surface 69. As the air flow between the valve member 65 and the cylinder head opening 66 increases, there is an increased force urging the valve head 68 towards the surface 69 against the force of the leaf spring 67. When the air flow force exceeds the force of the leaf spring 67, the valve member 65 moves up until an 0 ring seal 73 on the head 68 engages the surface 69, closing the valve 63. The air pressure in the compression chamber 70 will immediately increase and hold the valve 63 closed. The valve 63 will remain closed until the force of the air pressure in the compression chamber 70 acting on the valve member head 68 falls below the force exerted by the leaf spring 67 on the valve member 65. The valve 63 will then remain open until the air flow through the cylinder head opening 66 is sufficient to close the valve 63.

It will be appreciated that various modifactions and changes may be made to the above described preferred embodiment of without departing from the scope of the following claims.

I claim:

1. An electric motor operated compressor comprising:

an air compressor having a pressurized air output;

a compressed air storage tank;

an air line connected to deliver pressurized air from said compressor output to said tank;

a motor connected to drive said air compressor, said motor having insufficient torque to start when said air compressor is loaded by pressurized air in said air line;

a valve body located between said air line and said tank, said valve body having:

a check valve in a first bore for preventing the flow of pressurized air from said tank to said air line while permitting the flow of pressurized air from said air line to said tank; and a vent valve for venting pressure from said air line, said vent valve being positioned in a second bore communicating with said first bore, said second bore having an open vent end, and said vent valve including:

an unloader valve; and spring means urging said unloader valve away from said open vent end;

where said unloader valve is adapted to be moved against the force of said spring means to interrupt venting of said air line in response to a predetermined air flow from said second bore through said open vent end;

means for opening said vent valve when said motor is stopped to vent air from said air line to unload said air compressor and for closing said vent valve when said motor is operating; and means for preventing closure of said vent valve when said motor is initially started until after the torque developed by said motor exceeds the torque required to drive said air compressor when loaded by pressurized air in said air line.

2. An electric motor operated compressor comprising:

an air compressor having a pressurized air output;

a compressed air storage tank;

an air line connected to deliver pressurized air from said compressor output to said tank;

a permanent split capacitor motor connected to drive said air compressor, said motor having substantially the same capacitance for starting as for operating and having insufficient torque to start when said air compressor is loaded by pressurized air in said air line;

a valve body located between said air line and said tank, said valve body having:

a check valve for preventing the flow of pressurized air from said tank to said air line while permitting the flow of pressurized air from said air line to said tank, said check valve being positioned in a stepped first bore having a step defining a conical valve seat facing one end of said first bore, and said check valve including:

an annular ledge extending radially inwardly at said one bore end;

a check valve ball positioned in said first bore and adapted for seating against said seat; and a compression spring compressed between said annular ledge and said check valve ball to urge said check valve ball towards said seat; and a vent valve for venting pressure from said air line, said vent valve being positioned in a second bore communicating with said first bore, said second bore having an open vent end, and said vent valve including:

an unloader valve; a conical seat for said unloader valve adjacent said open vent end;

spring means urging said unloader valve away from said open vent end;

where said unloader valve is adapted to be moved against the force of said spring means to engage said conical seat for said unloader valve in response to a predetermined air flow from said second bore through said open vent end;

means for opening said vent valve when said motor is stopped to vent air from said air line to unload said air compressor and for closing said vent valve when said motor is operating; and means for preventing closure of said vent valve when said motor is initially started until after the torque developed by said motor exceeds the torque required to drive said air compressor when loaded by pressurized air in said air line.

3. An electric motor operated compressor, as set forth in claim 2, and wherein said compression spring has an end coil at a first end of a size for engaging said check valve ball, has increasing coil diameters towards a second end and has triangular shaped second end engaging said annular ledge, said second spring end retaining said compression spring and said check valve ball in said first bore.

4. A valve assembly for an air compressor having an air line delivering pressurized air to an air tank, said valve assembly comprising a valve body having:

a check valve in a first bore for preventing the flow of pressurized air from said tank to said air line while permitting the flow of pressurized air from said air line to said tank; and a vent valve for venting pressure from said air line, said vent valve being positioned in a second bore communicating with said first bore, said second bore having an open vent end, and said vent valve including:

an unloader valve; and spring means urging said unloader valve away from said open vent end;

where said unloader valve is adapted to be moved against the force of said spring means to interrupt venting of said air line in response to a predetermined air flow from said second bore through said open vent end.

5. A valve assembly for an air compressor, as set forth in claim 4, including:

means for opening said vent valve when a motor is stopped to vent air from said air line to unload said air compressor and for closing said vent valve when said motor is operating; and means for preventing closure of said vent valve when said motor is initially started until after the torque developed by said motor exceeds the torque required to drive said air compressor when loaded by pressurized air in said air line.

6. A valve assembly for an air compressor as set forth in claim 4, and wherein said first bore is a stepped bore having a step defining a conical check valve seat facing one end of said first bore, an annular ledge extending radially inwardly at said one end of said first bore, wherein said check valve is positioned in said first bore and adapted for seating against said check valve seat, a compression spring compressed between said annular ledge and said check valve seat to urge said check valve means towards said check valve seat, and wherein said unloader valve in said second bore is movable between a first position wherein said open vent end communicates with said first bore and a second position wherein said unloader valve interrupts the flow of air from said first bore to said open vent end, and wherein said unloader valve is adapted to be moved from said first position to said second position by a predetermined flow of air from said first bore through said open vent end.

7. A valve assembly for an air compressor, as set forth in claim 6, and wherein said compression spring has an end coil at a first end of a size for engaging said check valve means, has increasing coil diameters towards a second end and has triangular shaped second end engaging said annular ledge, said second spring end retaining said compression spring and said check valve in said first bore.

8. A valve assembly for an air compressor, as set forth in claim 6, wherein said second bore defines a seat for said unloader valve facing away from said open vent end, wherein said unloader valve engages said seat for said unloader valve when said unloader valve is in said second position, and including said spring means urging said unloader valve away from said seat for said unloader valve.

* * * * *